US005420007A

United States Patent [19]

Goan

[11] Patent Number: 5,420,007

[45] Date of Patent: May 30, 1995

[54] METHOD OF PRODUCING SILVER HALIDE PHOTOGRAPHIC EMULSION

[75] Inventor: Kazuyoshi Goan, Hino, Japan

[73] Assignee: Konica Corporation, Japan

[21] Appl. No.: 227,260

[22] Filed: Apr. 14, 1994

[30] Foreign Application Priority Data

Apr. 19, 1993 [JP] Japan ..... 5-091485

[51] Int. Cl.[6] ..... G03C 1/005; G03C 1/015

[52] U.S. Cl. ..... 430/569; 430/567

[58] Field of Search ..... 430/567, 569

[56] References Cited

U.S. PATENT DOCUMENTS 4,798,775 1/1989 Yagi et al. ..... 430/567

5,204,235 4/1993 Yamamoto et al. ..... 430/569

FOREIGN PATENT DOCUMENTS 443475 8/1991 European Pat. Off. .

492519 7/1992 European Pat. Off. .

*Primary Examiner*—Charles L. Bowers, Jr.

*Assistant Examiner*—Mark F. Huff

*Attorney, Agent, or Firm*—Jordan B. Bierman; Bierman and Muserlian

[57] ABSTRACT

A method for preparing silver halide emulsion which comprises silver halide grains containing an average iodide content of not more than 2 mol % comprising the steps of (i) preparing a seed emulsion containing silver halide seed grains, (ii) introducing the seed emulsion into a reaction vessel containing a hydrophilic colloid solution and (iii) introducing into the reaction vessel a silver salt and a halide salt to grow the silver halide grains from the seed grains, wherein in the step (iii), an emulsion containing silver iodide fine grains previously formed is supplied into the reaction vessel as a source of silver iodide; said seed grains are contained in an amount of 0.5 to 5.0% by volume in the hydrophilic colloid solution in the reaction vessel prior to introduction of silver and halide salts.

7 Claims, No Drawings

METHOD OF PRODUCING SILVER HALIDE PHOTOGRAPHIC EMULSION

FIELD OF THE INVENTION

The present invention relates to a method of producing a silver halide photographic emulsion, more specifically a method of producing a silver halide photographic emulsion of low fogging and high sensitivity showing improved storage stability under high-temperature, high-humidity conditions.

BACKGROUND OF THE INVENTION

In recent years, there has been increased consumption of silver halide photographic light-sensitive materials. Accordingly, the number of silver halide photographic light-sensitive material films processed has increased; there is a need for more rapid processing, i.e., increased processing-capacity per unit time period.

This trend is seen in all fields of light-sensitive materials. In the field of medical X-ray light-sensitive materials, for example, the rapid increase in medical examinations and testing parameters is increasing the number of X-ray photographs taken, while the diagnostic results must be informed for the subject as soon as possible. To meet this requirement, rapid processing is required. In angiographic picture taking and perioperative picture taking, in particular, it is necessary to obtain the picture in minimum time.

To meet the above demand from the medical field, it is necessary to more rapidly process X-ray films, as well as to promote diagnostic automation (picture taking, film transport, etc.).

Ultrarapid processing, however, can pose a problem of image quality deterioration because it is often performed under high-pH, high-temperature (30° to 40° C.) conditions.

To meet the above demand for rapid processing and high image quality, tabular silver halide grains have recently been used. With high specific surface area, tabular silver halide grains are unique in that they can adsorb large amounts of sensitizing dyes and can therefore have improved spectral sensitivity, that they significantly reduce crossover light as in X-ray light-sensitive materials, and that images of high resolution with little light scattering are obtained. The use of such tabular grains is expected to offer silver halide photographic light-sensitive materials of high sensitivity and high image quality. Investigations by the present inventors showed, however, that tabular grains have a major drawback that their storage stability under high-temperature, high-humidity conditions is poor so that they are liable to be fogged and desensitized.

SUMMARY OF THE INVENTION

The object of the present invention is to provide a method of producing a silver halide photographic emulsion having low fog and high sensitivity and showing improved storage stability under high-temperature, high-humidity conditions, The above object of the present invention is accomplished by a method of producing a silver halide photographic emulsion having an average silver iodide content of not more than 2.0 mol %, wherein said emulsion is subjected to a grain growing process in which fine silver iodide grains are supplied to a hydrophilic colloid solution containing previously prepared silver halide seed grains, and wherein the seed grain concentration by volume in the hydrophilic colloid solution containing seed grains, in the reaction vessel, is not less than 0.5% and not more than 5%.

In a preferred embodiment of the present invention, the above silver halide emulsion comprises monodispersed twin crystal silver halide grains each having a core consisting of a silver iodobromide having a silver iodide content of not less than 10 mol %, and a shell consisting of a silver iodobromide having a silver iodide content of not more than 7 mol %.

DETAILED DESCRIPTION OF THE INVENTION

The present invention is hereinafter described in detail.

Silver halide grains are usually produced and used in the form of a silver halide emulsion containing them. The silver halide grains used for the present invention may have any shape, whether spherical or tabular, for instance. Preferably, the silver halide grains are monodispersed twin crystal grains wherein at least 50% of the total projected area is occupied by monodispersed twin crystal grains having a thickness of less than 0.3 μm and a grain diameter/thickness ratio of not less than 2:1, more preferably those having a thickness of less than 0.2 μm and a grain diameter/thickness ratio of 5:1 to 8:1 account for at least 50% of the total projected area.

In the present invention, grain size is defined as the diameter of a circle converted from a projected image of the grain of the same area. Grain thickness is defined as the distance between two mutually facing principal planes of a tabular grain. The projected area of grains can be obtained by summing the areas of grains thus obtained. The projected area of each grain for determination of total projected area and grain diameter can be obtained by measuring the diameter of the grain or the projected area of a circle on an electron micrograph of a silver halide crystal sample spread over the sample stage to the extent that no grain overlapping occurs, taken at x 10000 to 50000 magnification; the number of subject grains should not be less than 1000 randomly.

Grain thickness can be determined by obliquely observing the sample using an electron microscope.

A highly monodispersed emulsion preferred for the present invention has a distribution width of not more than 30%, more preferably not more than 20%, as defined by the equation:

$$(\text{Grain size standard deviation/average grain size}) \times 100 = \text{distribution width or coefficient of variation } (\%)$$

Here, grain size is determined by the method described above, and average grain size is obtained as an arithmetic mean.

$$\text{Average grain size} = \Sigma dini/\Sigma ni$$

In the present invention, a twin crystal grain is defined as a silver halide crystal grain having one or more twin planes. The morphological classification of twin crystals is described in detail by Klein and Meuzer (Photographishe Korrespondenz, Vol. 99, p. 99; ibid., Vol. 100, p. 57). The two or more twin planes of the twin crystal may be mutually parallel or not. Although a twin plane may be directly observed using an electron microscope, it may be observed on a cross-section of an ultrathin sectional sample of resin-dispersed, fixed silver halide.

The above-described silver halide grains constituting the silver halide emulsion relating to the present invention mainly comprise twin crystal grains having two or more parallel twin planes, preferably even number of twin planes, more preferably two twin planes.

In the present invention, "to mainly comprise twin crystal grains having two or more parallel twin planes" means that the percent ratio by number of twin crystal grains having two or more parallel twin planes is not less than 50%, preferably not less than 60%, and more preferably not less than 70%.

A monodispersed twin crystal in the present invention has a grain size distribution width of not more than 30%, preferably not more than 20%.

The silver halide composition of the silver halide emulsion of the present invention may be silver iodobromide or silver iodochlorobromide containing not more than 2.0 mol %, preferably 2.0 to 0.05 mol % of silver iodide.

Concerning the halogen distribution within the grain, the halogen composition may be uniform or different between the inner and outer portion, and may be of a layer structure (core/shell structure). A more preferable structure comprises an inner phase consisting of a silver iodobromide having a silver iodide content of not less than 10 mol % and an outer phase consisting of a silver iodobromide having a silver iodide content of not more than 7 mol %.

The silver halide emulsion of the present invention is formed by growing grains using a previously formed silver halide emulsion as a seed emulsion. Although a silver halide photographic emulsion of the present invention can be prepared by any one of the acidic method, the neutral method, the ammoniacal method and other methods, the double jet method is used to react a soluble silver salt and a soluble halogen salt. As a modification of the double jet method, the controlled double jet method can be used, in which the pAg of the liquid phase where silver halide is formed is kept constant. This method makes it possible to prepare a silver halide emulsion containing grains having regular crystal shape and nearly uniform grain size distribution.

In the present invention, the seed grain concentration by volume in the hydrophilic colloid solution containing seed grains, previously contained in the reaction vessel is not less than 0.5% and not more than 5%, preferably not less than 1.0% and not more than 3%, as silver halide.

Here, the seed grain concentration is defined by the following equation:

Seed grain concentration (%)=[total volume (ml) of silver halide seed grains×100]/[volume (ml) of hydrophilic colloid solution in reaction vessel]

where the total volume of seed grains is defined as the product of an average volume of the seed grains and total number thereof.

An average grain size of the seed grains is 0.3 μm or less in a sphere-equivalent diameter, and preferably, 0.1 to 0.25 μm, wherein the sphere-equivalent diameter is referred to as the average diameter when the volume of the seed grain is converted into a sphere having an equivalent volume.

The fine silver iodide grains of the present invention (hereinafter referred to as fine grains) are hereinafter described. Although preferable fine grain size varies depending on the size and halogen composition of the host silver halide grains because fine grain size affects the rate of iodide ion supply, fine grains having an average sphere-equivalent diameter of not more than 0.3 μm, more preferably not more than 0.1 μm are used. For precipitating silver halide on host grains by recrystallization of fine grains, it is preferable that the fine grain size be smaller than the sphere-equivalent diameter of the host grains, more preferably smaller than one-tenth of the sphere-equivalent diameter. The halogen composition of the fine grains has a silver iodide content of not less than 95 mol %, preferably 100 mol %.

The silver halide emulsion relating to the present invention incorporates various hydrophilic colloids for silver halide enclosure as binders. For this purpose, gelatin and other photographic binders such as synthetic polymers, e.g., polyvinyl alcohol and polyacrylamide, and colloidal albumin, polysaccharides and cellulose derivatives may be used.

The silver halide emulsion used in the present invention may be treated by an appropriate method of removing soluble salt to obtain a Ag ion concentration suitable for chemical sensitization. Available methods include those described in Research Disclosure No. 17643 (December 1978), such as the flocculation method and the noodle washing method. Preferable washing methods include the method described in Japanese Patent Examined Publication No. 16086/1960, which uses an aromatic hydrocarbon aldehyde resin containing sulfonic acid, and the method described in Japanese Patent Publication Open to Public Inspection No. 158644/1988, which uses example compounds G-3 and G-8 and other polymeric flocculants.

The photographic light-sensitive material incorporating the silver halide photographic emulsion of the present invention may incorporate various photographic additives added before or after physical or chemical ripening of the emulsion.

Examples of such photographic additives include the compounds described in Research Disclosure (hereinafter referred to as RD) Nos. 17643, 18716 (November 1979) and 308119 (December 1989). The compounds and portions where they are described are given below.

| | RD-17643 | | RD-18716 | | RD-308119 | |
|---|---|---|---|---|---|---|
| Additive | Page | Section | Page | Section | Page | Section |
| Chemical sensitizer | 23 | | 648 upper right | | 996 | |
| Sensitizing dye | 23 | | 648–649 | | 996–998 | |
| Desensitizing dye | 23 | | | | 998 | B |
| Dye | 25–26 | | 649–650 | | 1003 | |
| Developing accelerator | 29 | XXI | 648 upper right | | | |
| Antifoggant agent and | 24 | | 649 upper | | 1006–1007 | |

-continued

| Additive | RD-17643 Page | RD-17643 Section | RD-18716 Page | RD-18716 Section | RD-308119 Page | RD-308119 Section |
|---|---|---|---|---|---|---|
| stabilizer | | | right | | | |
| Brightening agent | 24 | | | | 998 | |
| Hardener | 26 | | 651 left | | 1004–1005 | |
| Surfactant | 26–27 | XI | 650 right | | 1005–1006 | XI |
| Plasticizer | 27 | XXI | 650 right | | 1006 | XXI |
| Lubricant | 27 | XXI | | | | |
| Matting agent | 28 | XVI | 650 right | | 1008–1009 | XVI |
| Binder | 26 | XXII | | | 1003–1004 | |
| Support | 28 | XVII | | | 1009 | XVII |

Examples of supports which can be used in the silver halide photographic light-sensitive material of the present invention include those specified on the above-mentioned Research Disclosures. Appropriate supports are plastic films etc., whose surface may be subbed or treated by corona discharge or ultraviolet irradiation to enhance coating layer adhesion.

The light-sensitive material of the present invention may be processed with processing solutions such as those described on pages 29–30, XX–XXI, RD-17643 above and pages 1011–1012, XX–XXI, RD-308119 above.

As developing agents for black-and-white photographic processing, dihydroxybenzenes such as hydroquinone, 3-pyrazolidones such as 1-phenyl-3-pyrazolidone, aminophenols such as N-methyl-aminophenol and others may be used singly or in combination. The developer of the present invention may incorporate as necessary known additives such as preservatives, alkalis, pH buffers, antifoggants, hardeners, developing accelerators, surfactants, antifoaming agents, toning agents, hard water softening agents, dissolution aids and thickener.

The fixer may incorporate a fixing agent such as a thiosulfate or thiocyanate, and may also contain a water-soluble aluminum salt as a hardener, such as aluminum sulfate or potassium alum. Preservatives, pH regulators, hard water softening agents and other additives may also be incorporated in the fixer.

EXAMPLES

The present invention is hereinafter described in more detail by means of the following examples, but the invention is not by any means limited by them.

Example 1

Preparation of seed emulsion

A hexagonal tabular seed grain emulsion was prepared as follows:

| | |
|---|---|
| Solution A | |
| Ossein gelatin | 60.2 g |
| Distilled water | 20.0 l |
| 10% methanol solution of $HO(CH_2CH_2O)_n—[(CH(CH_3)CH_2O]_m—(CH_2CH_2O)_n—H_{n+m=5.7}$ | 5.6 ml |
| KBr | 26.8 g |
| 10% $H_2SO_4$ | 144 ml |
| Solution B | |
| 2.5 N aqueous $AgNO_3$ solution | 3500 ml |
| Solution C | |
| KBr | 1029 g |
| KI 29.3 g | |
| Water was added to make a total quantity of 3500 ml. | |
| Solution D | |
| 1.75 N aqueous KBr solution | Amount required to obtain the silver potential shown below. |

Using the mixer stirrer described in Japanese Patent Examined Publication Nos. 58288/1983 and 58289/1983, solutions B and C, each 64.1 ml, were added to solution A at 35° C. by the double jet method over a period of 2 minutes to form nuclei.

After stopping the addition of solutions B and C, the temperature of solution A was increased to 60° C. over a period of 60 minutes, and solutions B and C were again added by the double jet method at a flow rate of each 68.5 ml/min over a period of 50 minutes, while keeping the silver electrode potential (determined using a silver ion selective electrode in combination with a saturated silver-silver chloride electrode as a reference electrode) at +6 mV using solution D. After completion of the addition, 3% KOH was added to obtain a pH of 6, followed by immediate desalinization and washing. The resulting emulsion was designated as seed emulsion EM-0. Electron microscopy revealed that this emulsion comprised hexagonal tabular silver halide grains not less than 90% by projected area of which had a maximum adjacent edge ratio of 1.0 to 2.0 and which tabular grains had an average thickness of 0.07 μm and an average diameter of 0.5 μm in circle-equivalent diameter and 0.24 μm in sphere-equivalent diameter. Preparation of fine silver iodide grain emulsion A fine silver iodide grain emulsion was prepared as follows:

| | |
|---|---|
| Solution A | |
| Ossein gelatin | 100 g |
| KI 8.5 g | |

-continued

| | |
|---|---|
| Distilled water was added to make a total quantity of 2000 ml. | |
| Solution B | |
| $AgNO_3$ | 360 g |
| Distilled water was added to make a total quantity of 605 ml. | |
| Solution C | |
| KI | 352 g |
| Distilled water was added to make a total quantity of 605 ml. | |

While stirring solution A at 40° C. in the reaction vessel, solutions B and C were added at constant rate by the double jet precipitation method over a period of 30 minutes.

During the addition, pAg was kept at 13.5 by a conventional means of pAg control. The resulting silver iodide was a mixture of $\beta$-AgI and $\gamma$-AgI having an average grain size of 0.06 $\mu$m.

This emulsion is referred to as a fine silver iodide grain emulsion.

Preparation of comparative tabular emulsions EM-1 through EM-6

Using the three solutions shown below, comparative tabular silver iodobromide emulsions EM-1 through 6 were prepared, which had a silver iodide content of 1.53 mol %.

| | |
|---|---|
| Solution A | |
| Ossein gelatin | 29.4 g |
| Seed emulsion EM-0 | Equivalent to 0.588 mol |
| 10% methanol solution of $HO(CH_2CH_2O)_n—[(CH(CH_3)CH_2O]_m—(CH_2CH_2O)_n—H_{n+m=5.7}$ | 2.5 ml |
| Distilled water was added to make a total quantity of 2360 ml. | |
| Solution B | |
| $AgNO_3$ | 1404 g |
| Distilled water was added to make a total quantity of 2360 ml. | |
| Solution C | |
| KBr | 968 g |
| KI 20.6 g | |
| Distilled water was added to make a total quantity of 2360 ml. | |

Using the mixer-stirrer disclosed in Japanese Patent Examined Publication Nos. 58288/1983 and 58289/1983, the entire amounts of solutions B and C were added to solution A at 60° C. by the double-jet precipitation method at flow rates such that the final flow rate would triple the initial flow rate over a period of 110 minutes, to grow grains.

During this operation, silver electrode potential was controlled at +25 mV using a 1.75N aqueous solution of potassium bromide.

After completion of the addition, the following sensitizing dyes A and B were added at 300 mg/mol Ag and 15 mg/mol Ag, respectively, after which the mixture was precipitated and desalinized to remove excess salts, using an aqueous solution of Demol (produced by Kao Atlas) and an aqueous solution of magnesium sulfate. The mixture was then stirred and re-dispersed in an aqueous gelatin solution containing 92.2 g of ossein gelatin to a total quantity of 2500 ml.

Sensitizing dye A: 5,5'-dichloro-9-ethyl-3,3'-di-(3-sulfopropyl)oxacarbocyanine salt anhydride Sensitizing dye B: 5,5'-di-(butoxycarbonyl)-1,1'-diethyl-3,3'-di-(4-sulfobutyl)benzimidazolocarbocyanine sodium salt anhydride About 3000 grains of each dispersion were observed and morphologically analyzed using an electron microscope. The results are given in Table 1.

Preparation of comparative or inventive tabular emulsions EM-7 through 12

Using the four solutions shown below, comparative or inventive tabular silver iodobromide emulsions EM-7 through 12 were prepared, which had a silver iodide content of 1.53 mol %.

| | |
|---|---|
| Solution A | |
| Ossein gelatin | 29.4 g |
| Seed emulsion EM-0 | Equivalent to 0.588 mol |
| 10% methanol solution of $HO(CH_2CH_2O)_n—[(CH(CH_3)CH_2O]_m—(CH_2CH_2O)_n—H_{n+m=5.7}$ | 2.5 ml |
| Distilled water was added to make a quantity shown in Table 1. | |
| Solution B | |
| $AgNO_3$ | 1382 g |
| Distilled water was added to make a total quantity of 2322 ml. | |
| Solution C | |
| KBr | 968 g |
| Distilled water was added to make a total quantity of 2322 ml. | |
| Solution D | |
| Fine silver iodide emulsion | Equivalent to 0.124 mol. |

Using the mixer-stirrer disclosed in Japanese Patent Examined Publication Nos. 58288/1983 and 58289/1983, the entire amounts of solutions B, C and D were added to solution A at 60° C. by the triple-jet precipitation method at an accelerated flow rate such that the final flow rate would triple the initial flow rate over a period of 110 minutes, to grow grains.

During this operation, silverel potential was controlled at +25 mV using a 1.75N aqueous solution of potassium bromide.

After completion of the addition, sensitizing dyes A and B were added in amounts of 300 mg/mol Ag and 15 mg/mol Ag, respectively, in the same manner as for EM-1, after which the emulsion was coagulated and desalinized to remove excess salts, using an aqueous solution of Demol (produced by Kao Atlas) and an aqueous solution of magnesium sulfate. The mixture was then stirred and re-dispersed in an aqueous gelatin solution containing 92.2 g of ossein gelatin to a total quantity of 2500 ml.

About 3000 grains of each emulsion were observed and morphologically analyzed using an electron microscope. The results are given in Table 1.

-continued

Compound B

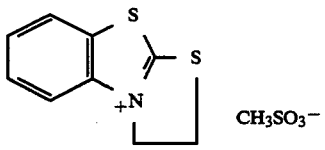

TABLE 1

| Emulsion No. | Solution A Volume (ml) | Solution A Seed grain concentration (%) by volume | Average grain diameter d (μm) | Average thickness h (μm) | d/h | Distribution width (%) | Remark |
|---|---|---|---|---|---|---|---|
| EM-1 | 4000 | 0.43 | 1.05 | 0.25 | 4.2 | 18 | Comp. |
| EM-2 | 3000 | 0.58 | 1.03 | 0.26 | 4.0 | 18 | Comp. |
| EM-3 | 1500 | 1.15 | 1.02 | 0.27 | 3.8 | 18 | Comp. |
| EM-4 | 1000 | 1.73 | 1.03 | 0.26 | 4.0 | 18 | Comp. |
| EM-5 | 500 | 3.46 | 1.02 | 0.27 | 3.8 | 18 | Comp. |
| EM-6 | 250 | 6.92 | 1.01 | 0.28 | 3.6 | 18 | Comp. |
| EM-7 | 4000 | 0.43 | 1.05 | 0.25 | 4.2 | 18 | Comp. |
| EM-8 | 3000 | 0.58 | 1.03 | 0.26 | 4.0 | 18 | Inv. |
| EM-9 | 1500 | 1.15 | 1.02 | 0.27 | 3.8 | 18 | Inv. |
| EM-10 | 1000 | 1.73 | 1.03 | 0.26 | 4.0 | 18 | Inv. |
| EM-11 | 500 | 3.46 | 1.02 | 0.27 | 3.8 | 18 | Inv. |
| EM-12 | 250 | 6.92 | 1.01 | 0.28 | 3.6 | 18 | Comp. |

Comp.: Comparative
Inv.: Inventive

Preparation of Samples

To each emulsion, sensitizing dyes A and B were added at 140 mg/mol Ag and 1.4 mg/mol Ag, respectively, after which the emulsion was chemically ripened with $7.0\times10^{-4}$ mol per mol silver of ammonium thiocyanate and appropriate amounts of chloroauric acid and hypo. After $6\times10^{-4}$ mol/mol Ag of a fine silver iodide emulsion having an average grain size of 0.06 μm was added, the mixture was stabilized with $3\times10^{-2}$ mol of 4-hydroxy-6-methyl-1,3,3a,7-tetrazaindene.

To each emulsion, the following various additives were added.

The additives incorporated in the emulsion (light-sensitive silver halide coating solution) are as follows: The amount of addition is expressed per mol of silver halide.

| | |
|---|---|
| Compound A | 150 mg |
| t-butyl-catechol | 400 mg |
| Polyvinylpyrrolidone (molecular weight 10,000) | 1.0 g |
| Styrene-maleic anhydride copolymer | 2.5 g |
| Trimethylolpropane | 10 g |
| Diethylene glycol | 5 g |
| Nitrophenyl-triphenyl-phosphonium chloride | 50 mg |
| 1,3-ammonium dihydroxybenzene-4-sulfonate | 4 g |
| Sodium 2-mercaptobenzimidazole-5-sulfonate | 1.5 mg |
| Compound B | 70 mg |
| $n\text{-}C_4H_9OCH_2CH(OH)CH_2N(CH_2COOH)_2$ | 1 g |

Compound A

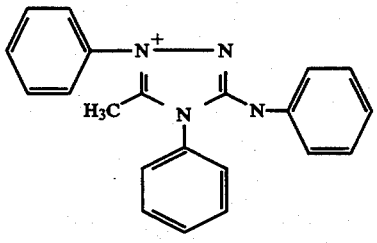

The additives incorporated in the protective layer coating solution are as follows: The amount of addition is expressed per gram of gelatin.

| | |
|---|---|
| Matting agent consisting of polymethyl methacrylate grains having an area-average grain size of 7 μm | 7 mg |
| Colloidal silica (average grain size 0.013 μm) | 70 mg |
| 2,4-dichloro-6-hydroxy-1,3,5-triazine sodium salt | 30 mg |
| $(CH_2{=}CHSO_2{-}CH_2{-})_2O$ | 36 mg |
| Compound C | 12 mg |
| Compound D | 2 mg |
| Compound E | 7 mg |
| Compound F | 15 mg |
| Compound G | 5 mg |
| $F_{19}C_9{-}O{-}(CH_2CH_2O)_{10}CH_2CH_2{-}OH$ | 3 mg |

Compound C

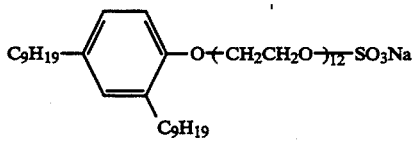

Compound D

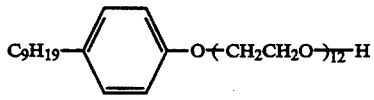

Compound E

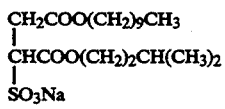

Compound F

-continued

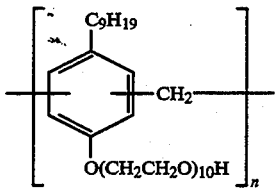

A mixture wherein n is 2 to 5.
Compound G $$NaO_3S-\underset{\underset{CH_2COOCH_2(C_2F_4)_3H}{|}}{CH}-COOCH_2(C_2F_4)_3H$$

The above coating solutions were uniformly coated and dried on both faces of a subbed blue-colored polyethylene terephthalate film base of 180 μm in thickness to yield samples 1 through 12 as listed in Table 2.

For all samples, the amount of grain coated was adjusted to 3.0 g/m$^2$, and the amount of silver coated 2.0 g/m$^2$ for each face.

The samples thus obtained were evaluated as follows:

Sensitometry and storage stability

The samples were kept standing at room temperature (20° C.) for 3 days (natural aging) or subjected to a accelerated aging test at 50° C. temperature and 80% humidity for 3 days. Each sample was then inserted between two sheets of sensitized paper KO-250 for X-ray photography and exposed to an X-ray via a penetrometer B, after which it was photographically processed with XD-SR developer at 35° C. for 45 seconds, using an automatic processing machine SRX-501. All materials and equipment used here were products of Konica Corporation.

Each sample thus processed was subjected to sensitometry. Sensitivity was obtained as a percent ratio to the reciprocal of the amount of exposure energy required for sample 1 to provide a density of fog+1.0.

Gamma was expressed as the gradient of the linear portion of the characteristic curve, and the fog value included a base density of 0.15.

The results are given in Table 2.

TABLE 2

| Sample No. | Emulsion No. | Natural aging Fog | Natural aging Sensitivity | Natural aging Gamma | Accelerated aging Fog | Accelerated aging Sensitivity | Accelerated aging Gamma | Remark |
|---|---|---|---|---|---|---|---|---|
| 1 | EM-1 | 0.26 | 100 | 2.8 | 0.45 | 93 | 2.5 | Comparative |
| 2 | EM-2 | 0.23 | 107 | 2.9 | 0.43 | 95 | 2.6 | Comparative |
| 3 | EM-3 | 0.17 | 147 | 3.0 | 0.36 | 120 | 2.8 | Comparative |
| 4 | EM-4 | 0.17 | 147 | 3.1 | 0.36 | 121 | 2.8 | Comparative |
| 5 | EM-5 | 0.17 | 147 | 3.1 | 0.37 | 119 | 2.8 | Comparative |
| 6 | EM-6 | 0.26 | 69 | 2.8 | 0.46 | 50 | 2.5 | Comparative |
| 7 | EM-7 | 0.26 | 104 | 2.8 | 0.43 | 93 | 2.5 | Comparative |
| 8 | EM-8 | 0.19 | 135 | 3.1 | 0.21 | 136 | 3.0 | Inventive |
| 9 | EM-9 | 0.17 | 152 | 3.1 | 0.18 | 152 | 3.1 | Inventive |
| 10 | EM-10 | 0.17 | 151 | 3.2 | 0.18 | 152 | 3.2 | Inventive |
| 11 | EM-11 | 0.17 | 150 | 3.1 | 0.18 | 150 | 3.1 | Inventive |
| 12 | EM-12 | 0.27 | 72 | 2.8 | 0.43 | 54 | 2.5 | Comparative |

From Table 2, it is seen that the samples according to the present invention have high levels of sensitivity and gamma value with low fog and show excellent storage stability under high-temperature, high-humidity conditions.

Example 2

Preparation of comparative tabular grain emulsions EM-13 through 18

Using the five solutions shown below, comparative tabular silver iodobromide grain emulsions EM-13 through 18 were prepared, which had an average silver iodide content of 2.0 mol %.

| | |
|---|---|
| Solution A | |
| Ossein gelatin | 29.4 g |
| Seed emulsion EM-0 | Equivalent to 0.588 mol. |
| 10% methanol solution of $HO(CH_2CH_2O)_n-[(CH(CH_3)CH_2O]_m-(CH_2CH_2O)_n-H_{n+m=5.7}$ | 2.5 ml |
| Distilled water was added to a final quantity shown in Table 3. | |
| Solution B | |
| $AgNO_3$ | 187 g |
| Distilled water was added to make a total quantity of 314 ml. | |
| Solution C | |
| KBr | 111 g |
| KI 27.7 g | |
| Distilled water was added to make a total quantity of 314 ml. | |
| Solution D | |
| $AgNO_3$ | 1217 g |
| Distilled water was added to make a total quantity of 2045 ml. | |
| Solution E | |
| KBr | 852 g |
| Distilled water was added to make a total quantity of 2045 ml. | |

Using the mixer-stirrer disclosed in Japanese Patent Examined Publication Nos. 58288/1983 and 58289/1983, the entire amounts of solutions B and C were added to solution A by the double-jet precipitation method at a constant flow rate over a period of 30 minutes, to grow grains. Subsequently, the entire amounts of solutions D and E were added by the double-jet precipitation method at an accelerated flow rate such that the final flow rate would double the initial flow rate (3 × from start to final) over a period of 90 minutes, to grow grains.

During this operation, silver electrode potential was controlled at +25 mV using a 1.75N aqueous solution of potassium bromide.

After completion of the addition, sensitizing dyes A and B were added in amounts of 300 mg/mol Ag and 15 mg/mol Ag, respectively, in the same manner as in Example 1, after which the emulsion was coagulated and desalinized to remove excess salts, using an aqueous solution of Demol (produced by Kao Atlas) and an aqueous solution of magnesium sulfate. The mixture was then stirred and re-dispersed in an aqueous gelatin solution containing 92.2 g of ossein gelatin to a total quantity of 2500 ml.

About 3000 grains of each dispersion were observed and morphologically analyzed using an electron microscope. The results are given in Table 3.

Preparation of comparative or inventive tabular grain emulsions EM-19 through 24

Using the six solutions shown below, comparative or inventive tabular silver iodobromide emulsions EM-19 through 24 were prepared, which had an average silver iodide content of 2.0 mol %.

| | |
|---|---|
| Solution A | |
| Ossein gelatin | 29.4 g |
| Seed emulsion EM-0 | Equivalent to 0.588 mol. |
| 10% methanol solution of $HO(CH_2CH_2O)_n—[(CH(CH_3)CH_2O]_m—(CH_2CH_2O)_n—H_{n+m=5.7}$ | 2.5 ml |
| Distilled water was added to a final quantity shown in Table 3. | |
| Solution B | |
| $AgNO_3$ | 159 g |
| Distilled water was added to make a total quantity of 267 ml. | |
| Solution C | |
| KBr | 111 g |
| Distilled water was added to make a total quantity of 267 ml. | |
| Solution D | |
| $AgNO_3$ | 1217 g |
| Distilled water was added to make a total quantity of 2045 ml. | |
| Solution E | |
| KBr | 852 g |
| Distilled water was added to make a total quantity of 2045 ml. | |
| Solution F | |
| Fine silver iodide emulsion | Equivalent to 0.167 mol. |

Using the mixer-stirrer disclosed in Japanese Patent Examined Publication Nos. 58288/1983 and 58289/1983, the entire amounts of solutions B, C and F were added to solution A at 60° C. by the triple-jet precipitation method at a constant flow rate over a period of 30 minutes, to grow grains. Subsequently, the entire amounts of solutions D and E were added at an accelerated flow rate such that the final flow rate would double the initial flow rate over a period of 90 minutes, to grow grains.

During the process, silver electrode potential was controlled at +25 mV using a 1.75N aqueous solution of potassium bromide.

After completion of the addition, sensitizing dyes A and B were added at 300 mg/mol Ag and 15 mg/mol Ag, respectively, in the same manner as in Example 1, after which the emulsion was coagulated and desalinized to remove excess salts, using an aqueous solution of Demol (produced by Kao Atlas) and an aqueous solution of magnesium sulfate. The mixture was then stirred and re-dispersed in an aqueous gelatin solution containing 92.2 g of ossein gelatin to a total quantity of 2500 ml.

About 3000 grains of each emulsion were observed and morphologically analyzed using an electron microscope. The results are given in Table 3.

TABLE 3

| Emulsion No. | Solution A Volume (ml) | Solution A Seed grain concentration (%) by volume | Average grain diameter d (μm) | Average thickness h (μm) | d/h | Distribution width (%) | Remark |
|---|---|---|---|---|---|---|---|
| EM-13 | 4000 | 0.43 | 0.90 | 0.34 | 2.6 | 23 | Comp. |
| EM-14 | 3000 | 0.58 | 0.89 | 0.35 | 2.5 | 22 | Comp. |
| EM-15 | 1500 | 1.15 | 0.85 | 0.39 | 2.2 | 25 | Comp. |
| EM-16 | 1000 | 1.73 | 0.84 | 0.40 | 2.1 | 25 | Comp. |
| EM-17 | 500 | 3.46 | 0.83 | 0.41 | 2.0 | 26 | Comp. |
| EM-18 | 250 | 6.92 | 0.80 | 0.44 | 1.8 | 27 | Comp. |
| EM-19 | 4000 | 0.43 | 0.94 | 0.31 | 3.0 | 20 | Comp. |
| EM-20 | 3000 | 0.58 | 0.92 | 0.32 | 2.9 | 20 | Inv. |
| EM-21 | 1500 | 1.15 | 0.91 | 0.33 | 2.8 | 20 | Inv. |
| EM-22 | 1000 | 1.73 | 0.91 | 0.33 | 2.8 | 20 | Inv. |
| EM-23 | 500 | 3.46 | 0.90 | 0.34 | 2.6 | 20 | Inv. |
| EM-24 | 250 | 6.92 | 0.89 | 0.35 | 2.5 | 24 | Comp. |

Comp.: Comparative
Inv.: Inventive

Preparation of Samples

Each emulsion was chemically ripened in the same manner as in Example 1 and then coated in the presence of various additives, to yield samples 13 through 24. Each sample was subjected to sensitometry and an accelerated deterioration test for storage stability in the same manner as in Example 1.

The results are given in Table 4.

TABLE 4

| Sample No. | Emulsion No. | Natural aging Fog | Natural aging Sensitivity | Natural aging Gamma | Accelerated aging Fog | Accelerated aging Sensitivity | Accelerated aging Gamma | Remark |
|---|---|---|---|---|---|---|---|---|
| 13 | EM-13 | 0.26 | 110 | 2.5 | 0.46 | 93 | 2.2 | Comparative |
| 14 | EM-14 | 0.23 | 108 | 2.6 | 0.45 | 92 | 2.3 | Comparative |
| 15 | EM-15 | 0.25 | 109 | 2.5 | 0.44 | 90 | 2.2 | Comparative |
| 16 | EM-16 | 0.25 | 108 | 2.4 | 0.45 | 86 | 2.0 | Comparative |
| 17 | EM-17 | 0.26 | 100 | 2.4 | 0.46 | 82 | 2.0 | Comparative |
| 18 | EM-18 | 0.27 | 65 | 2.3 | 0.46 | 45 | 1.8 | Comparative |
| 19 | EM-19 | 0.26 | 115 | 2.8 | 0.43 | 93 | 2.5 | Comparative |
| 20 | EM-20 | 0.17 | 145 | 3.0 | 0.20 | 146 | 2.9 | Inventive |
| 21 | EM-21 | 0.17 | 160 | 3.0 | 0.18 | 160 | 3.0 | Inventive |
| 22 | EM-22 | 0.17 | 159 | 3.1 | 0.18 | 159 | 3.1 | Inventive |
| 23 | EM-23 | 0.17 | 155 | 3.0 | 0.18 | 154 | 3.0 | Inventive |
| 24 | EM-24 | 0.27 | 80 | 2.8 | 0.46 | 64 | 2.5 | Comparative |

From Tables 2 and 4, it is seen that the samples according to the present invention have high levels of sensitivity and gamma value with low fog and undergo little performance deterioration over time under high-temperature, high-humidity conditions.

What is claimed is:

1. A method for preparing silver halide emulsion which comprises silver halide grains containing an average iodide content of not more than 2 mol % comprising the steps of (i) preparing a seed emulsion containing silver halide seed grains, (ii) introducing the seed emulsion into a reaction vessel containing a hydrophilic colloid solution and then (iii) introducing into the reaction vessel a silver salt and a halide salt to grow the silver halide grains from the seed grains, step (iii) further comprising incorporating into the reaction vessel an emulsion containing silver iodide fine grains having been separately formed as a source of silver iodide; said seed grains are contained in an amount of 0.5 to 5.0% by volume in the hydrophilic colloid solution in the reaction vessel prior to introduction of silver and halide salts.

2. The method of claim 1, wherein said silver halide emulsion comprises silver halide twin crystal grains having a grain thickness of less than 0.3 μm and a ratio of grain diameter to thickness of not less than 2, and accounting for at least 50% of total projected area of grains contained in the emulsion.

3. The method of claim 2, wherein said silver halide emulsion comprises monodispersed grains having a coefficient of variation in their size distribution of 20% or less.

4. The method of claim 1, wherein said silver halide emulsion comprises silver iodobromide or silver chloroiodobromide grains containing an iodide content of 0.05 to 2.0 mol %.

5. The method of claim 4, wherein said silver halide emulsion comprises silver iodobromide grains comprising an inner phase having an iodide content of not less than 10 mol % and an outer phase having an iodide content of not more than 7 mol %.

6. The method of claim 1, wherein said seed grains have an average grain size of 0.3 μm or less.

7. The method of claim 1, wherein said silver iodide fine grains have an average grain size smaller than that of said seed grains and within a range of 0.1 μm or less.

* * * * *